US006844668B2

(12) United States Patent
Choo

(10) Patent No.: US 6,844,668 B2
(45) Date of Patent: Jan. 18, 2005

(54) FLAT PANEL FOR USE IN A CATHODE RAY TUBE

(75) Inventor: Kyoung Mun Choo, Suwon-si (KR)

(73) Assignee: Samsung Corning Co., Ltd. (KR)

( * ) Notice: Subject to any disclaimer, the term of this patent is extended or adjusted under 35 U.S.C. 154(b) by 39 days.

(21) Appl. No.: 10/439,704

(22) Filed: May 16, 2003

(65) Prior Publication Data

US 2003/0214221 A1 Nov. 20, 2003

(30) Foreign Application Priority Data

May 17, 2002 (KR) ..... 10-2002-0027281
May 7, 2003 (KR) ..... 10-2003-0028940

(51) Int. Cl.[7] ..... H01J 31/00
(52) U.S. Cl. ..... 313/477 R; 313/461
(58) Field of Search ..... 313/477 R, 461

(56) References Cited

U.S. PATENT DOCUMENTS

2003/0122474 A1 * 7/2003 Lee ..... 313/477 R

* cited by examiner

*Primary Examiner*—Vip Patel
(74) *Attorney, Agent, or Firm*—Anderson Kill & Olick, PC

(57) ABSTRACT

A flat panel of the present invention is provided with a mold match line which is formed in a manner that H2 (a distance between a first plane passing through the mold match line and a second plane tangent to an outer contour of the face portion and parallel to the first plane) satisfies the following equation: $8 \leqq H2 \leqq T1 \times 2.24 - D^{0.5} \times 0.027$ when $T2/T1 \leqq 1.5$ and $D \leqq 500$ mm; $8 \leqq H2 \leqq T1 + T1/6.42 - D^{0.5} \times 0.027$ when $T2/T1 \leqq 1.5$ and 500 mm$<D \leqq 670$ mm; and $8 \leqq H2 \leqq T1 + T1/0.856 - D^{0.5} \times 0.027$ when $T2/T1 \leqq 1.5$ and $D > 670$ mm.

6 Claims, 4 Drawing Sheets

FLAT PANEL FOR USE IN A CATHODE RAY TUBE

FIELD OF THE INVENTION

The present invention relates to a flat panel for use in a cathode ray tube (CRT); and more particularly, to a flat panel which is capable of enhancing an implosion-resistance of a CRT by optimizing a forming position of a mold match line.

BACKGROUND OF THE INVENTION

As well known, a glass bulb in a cathode ray tube (CRT) used in a TV set or a computer monitor basically includes a panel for displaying picture images, a conical funnel sealed to the back of the panel and a cylindrical neck integrally connected to an apex portion of the conical funnel. The panel, the funnel and the neck are made of glass, wherein particularly the panel and the funnel are formed of predetermined dimensions and shapes by press forming a glass gob.

Referring to FIG. 1, there is illustrated a cross sectional view of a conventional glass bulb 10. A conventional flat panel 20 of the glass bulb 10 is provided with a face portion 21 whose inner surface is covered with an array of dots of fluorescent material (not shown) to display picture images; a skirt portion 23 extending backward from a perimeter of the face portion 21 and having a seal edge 22 on its back edge; and a blend round portion (or corner portion) 24 integrally joining the face portion 21 to the skirt portion 23. A funnel 30 of the glass bulb 10 can be divided into a body portion 32, i.e., a fore part thereof, having a seal edge 31 connected to the seal edge 22 of the skirt portion 23; and a yoke portion 33, i.e., a back part thereof, extending backward from the body portion 32. And a neck 40 of the glass bulb 10 is connected to the yoke portion 33 of the funnel 30. A tube axis 11 passes through the center of the face portion 21 and coincides with an axis of the neck 40. Placed by way of the so-called "shrinkage fit" scheme around the outer periphery of the skirt portion 23 is a metallic implosion-proof band 50, which strengthens the bulb 10 against tensile stress induced in the blend round portion 24 and the skirt portion 23 by evacuating the inner space of the bulb 10, so that fragments of the glass can be prevented from flying away when the panel 20 is broken or exploded.

Referring to FIG. 2, there is illustrated a schematic cross-sectional view of a mold set 60 for forming the panel 20. The mold set 60 is provided with a bottom mold 62 in which a cavity 61 is formed; a middle mold (or shell) 63, for forming the skirt portion 23 and the seal edge 22, which is fitted on top of the bottom mold 62; and an upper mold 64 (or plunger) which presses a glass gob loaded in the cavity 61 of the bottom mold 62 to form the panel 20. The upper mold 62 mold 64 is connected to a press ram 65, so that it can be lifted or lowered by the ram 65 so as to press the glass gob loaded in the cavity 61 of the bottom mold 62 to form the panel 20. There exists a parting line 66 between the bottom mold 62 and the middle mold 63. Therefore, when the panel 20 is formed in the mold set 60 as shown in FIG. 1, a mold match line 25, which is a flash made by the parting line 66, is formed on the outer periphery of the skirt portion 23 near the face portion 21. The peripheral length of the mold match line 25 represents the maximum peripheral length of the panel 20. And, in general, the position of the parting line 66 and thus the position of the mold match line 25 are set near the face portion 21 rather than the seal edge 22 in order to ease the extraction of the molded panel 20 from the bottom mold 62.

With reference to FIG. 1, the implosion-proof band 50 is installed in order to not only suppress from the flat panel 20 to the funnel 30 the propagation of waves and cracks incurred by an impact applied to the flat panel 20, but also reduce the vacuum stress of the bulb 10. And because the glass bulbs are getting thinner to lighten a CRT, the implosion-proof band is required to reduce comparatively more vacuum stress of the glass bulb to prevent implosion of the glass bulb. In order to do so, the following two schemes have been conventionally utilized: reducing the inner peripheral length of the pre-expanded implosion-proof band and moving the implosion-proof band toward the face portion. The first scheme relates only to a configuration of the implosion-proof band itself and hence is excluded from this discussion. The second scheme is to move the implosion-proof band toward the face portion, i.e., to increase the height of the implosion-proof band, but it has been carried out without changing the location of the mold match line. Therefore, if the implosion-proof band is moved above a certain height, it cannot reduce the vacuum stress anymore. That is, the implosion-proof band disposed above the certain height does not effectively clamp or compress a maximum peripheral length part of the flat panel, i.e., the mold match line.

Accordingly, in order to solve such a drawback, the forming position of the mold match line together with the installing position of the implosion-proof band need to be moved near the face portion while a predetermined distance between the mold match line and the upper edge of the implosion-proof band is maintained.

However, in a case where the mold match line is formed too close to the face portion, the outer contour of the blend round portion becomes sharp (or a sharp round) after a polishing process for removing defects from the outer surface of the face portion. This sharp round easily cracks and breaks even in a case where it is subject to a weak exterior impact.

Further, in a case where the mold match line is formed near the face portion of the flat panel, the skirt portion, which is not completely hardened, tends to bend inwardly when the upper mold is extracted from the first mold.

SUMMARY OF THE INVENTION

It is, therefore, an object of the present invention to provide a panel more capable of effectively suppressing an implosion of a CRT by optimizing the location of the mold match line without causing a sharp round of a blend round portion and a deflection of a skirt portion.

It has been found by the inventor of the present invention that by forming the mold match line in such a manner that a minimum distance between the mold match line and the face portion is secured, the outer contour of the blend round portion can be effectively prevented from becoming sharp while the implosion-proof band reduces the vacuum stress effectively.

Further, it has also been found that the occurrence of the bending of the skirt portion can be effectively prevented by the inventor of the present invention that by reducing the length of the skirt portion in a manner that a ratio of the skirt portion length to a diagonal length of an effective picture plane is less than a predetermined value.

In accordance with a preferred embodiment of the present invention, there is provided a flat panel for use in a cathode ray tube, including: a face portion having a center portion for displaying picture images and a periphery portion; a skirt portion extending from the periphery portion of the face portion and having an seal edge on its back edge; a mold match line formed on an outer periphery of the skirt portion; and a blend round portion joining the face portion with the skirt portion, wherein a mean outer contour curvature radius is equal to or greater than 10,000 mm, a wedge rate is equal to or less than 1.5, a diameter length D of the center portion is equal to or less than 500 mm, and a distance H2 satisfies the following equation: $8 \leqq H2 \leqq T1 \times 2.24 - D^{0.5} \times 0.027$ where the distance H2 is a distance between a first plane passing through the mold match line and a second plane tangent to an outer contour of the face portion and parallel to the first plane.

In accordance with another preferred embodiment of the present invention, there is provided a flat panel for use in a cathode ray tube, including: a face portion having a center portion for displaying picture images and a periphery portion; a skirt portion extending from the periphery portion of the face portion and having an seal edge on its back edge; a mold match line formed on an outer periphery of the skirt portion; and a blend round portion joining the face portion with the skirt portion, wherein a mean outer contour curvature radius is equal to or greater than 10,000 mm, a wedge rate is equal to or less than 1.5, a diameter length D of the center portion is 500 mm$<D \leqq$670 mm, and a distance H2 satisfies the following equation: $8 \leqq H2 \leqq T1 + T1/6.42 - D^{0.5} \times 0.027$ where the distance H2 is a distance between a first plane passing through the mold match line and a second plane tangent to an outer contour of the face portion and parallel to the first plane.

In accordance with still another preferred embodiment of the present invention, there is provided a flat panel for use in a cathode ray tube, including: a face portion having a center portion for displaying picture images and a periphery portion; a skirt portion extending from the periphery portion of the face portion and having an seal edge on its back edge; a mold match line formed on an outer periphery of the skirt portion; and a blend round portion joining the face portion with the skirt portion, wherein a mean outer contour curvature radius is equal to or greater than 10,000 mm, a wedge rate is equal to or less than 1.5, a diameter length D of the center portion is greater than 670 mm, and a distance H2 satisfies the following equation: $8 \leqq H2 \leqq T1 + T1/0.856 - D^{0.5} \times 0.027$ where the distance H2 is a distance between a first plane passing through the mold match line and a second plane tangent to an outer contour of the face portion and parallel to the first plane.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
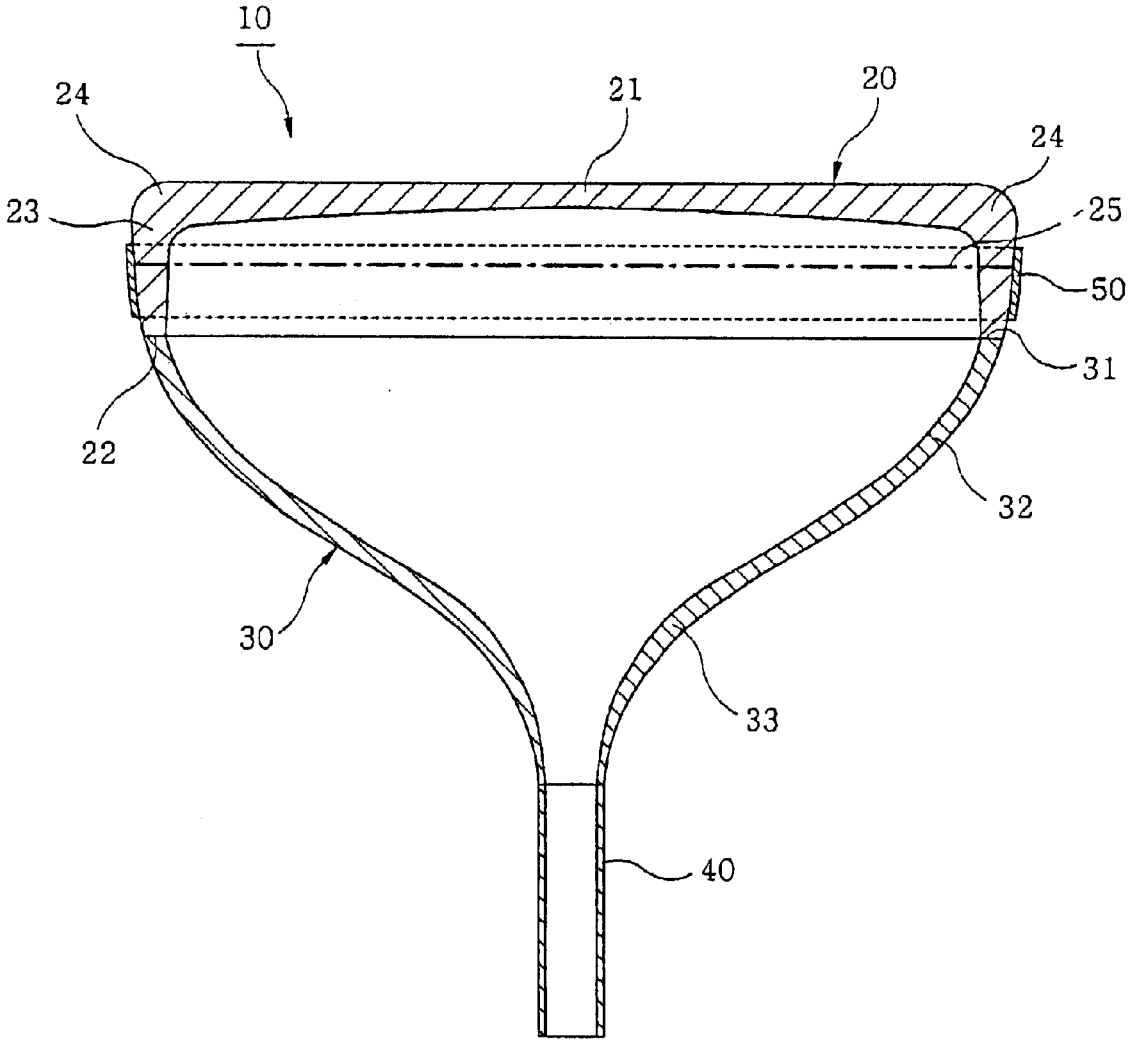
FIG. 1 (PRIOR ART)
FIG. 1 illustrates a schematic cross sectional view of a conventional glass bulb.
Figure 2:
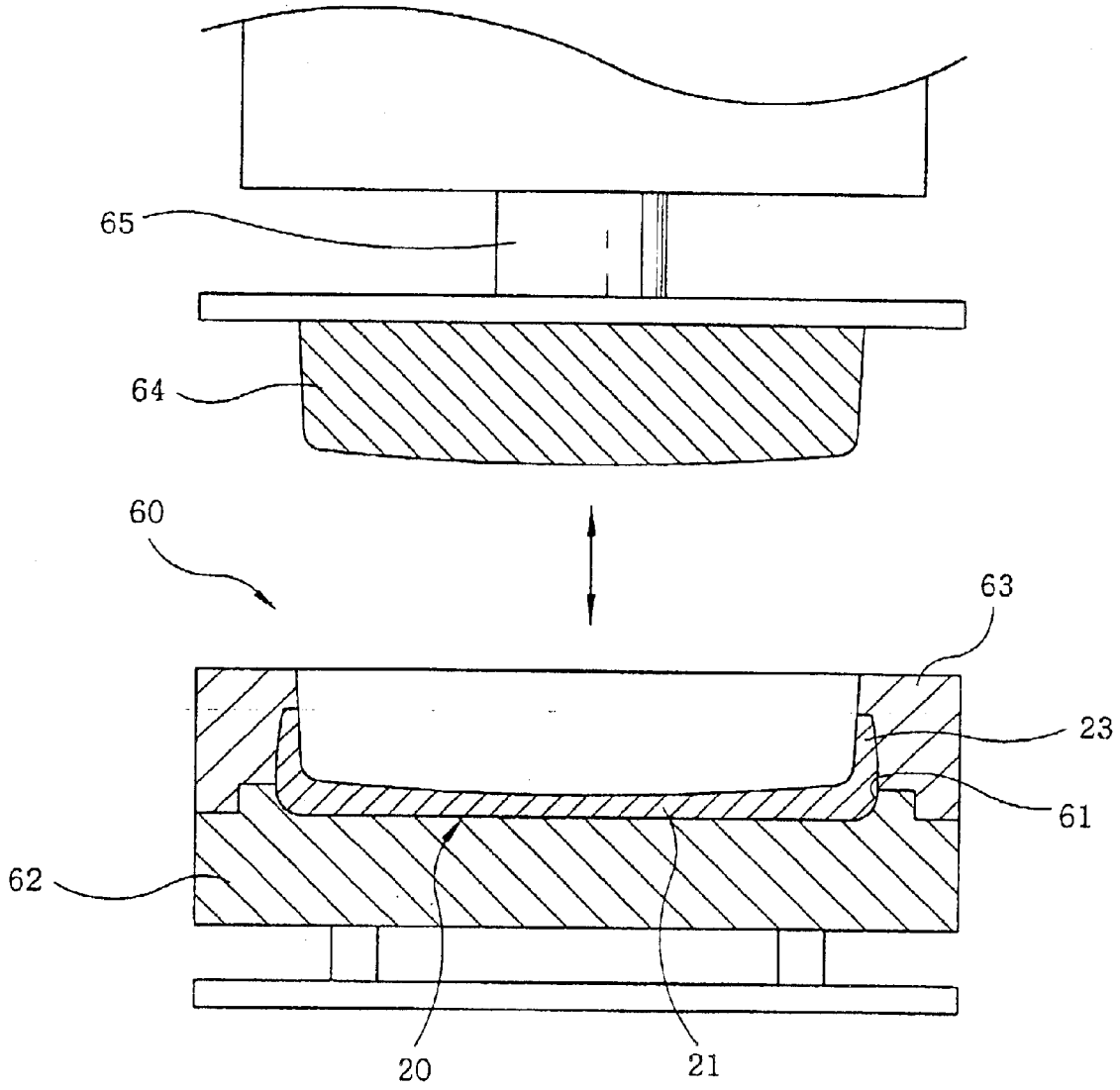
FIG. 2 presents a schematic cross sectional view of a mold set for forming a flat panel.

Panels for use in a cathode ray tube (CRT) in accordance with preferred embodiments of the present invention will now be described with reference to accompanying drawings. And like parts will be represented with like reference numerals.

Figure 3:
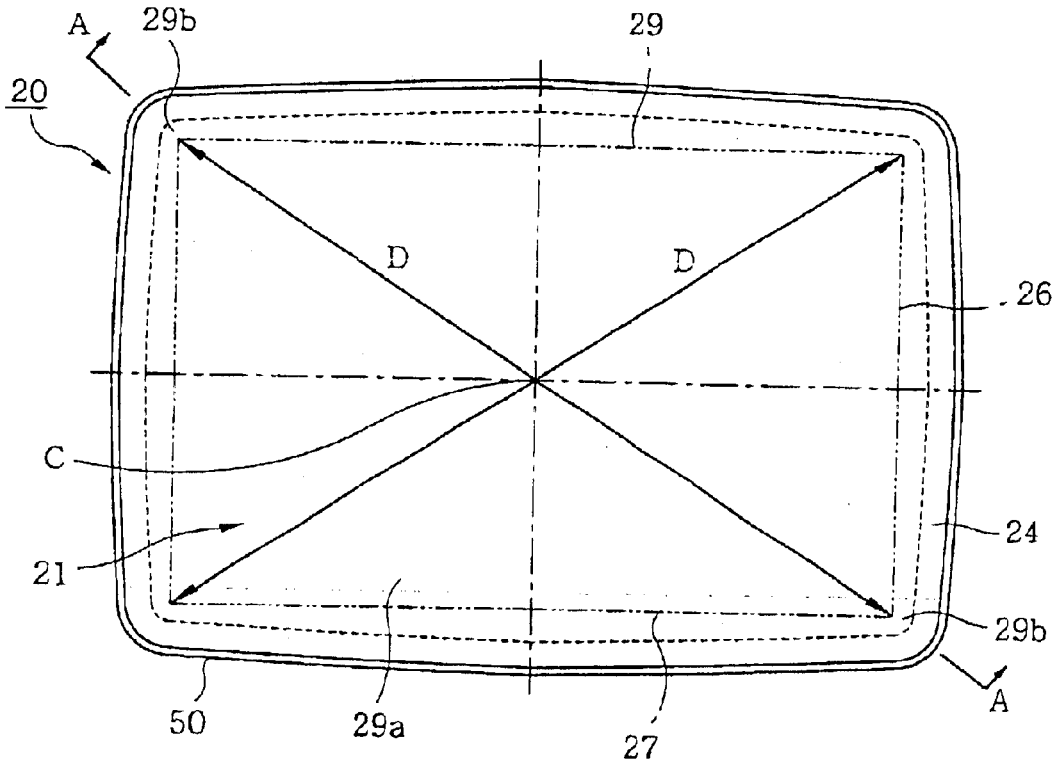
FIG. 3 offers a schematic top view of a flat panel in accordance with a preferred embodiment of the present invention.

Referring to FIG. 3, there is illustrated a schematic top view of a flat panel 20 in accordance with a preferred embodiment of the present invention. The flat panel 20 includes a face portion 21 for displaying picture images, which is provided with a center portion 29*a* serving as an effective picture plane (or useful screen) and a periphery portion 29*b*. The center portion 29*a* is in a shape of a rectangle and has a pair of short sides 26 and a pair of long sides 29. In addition, reference notations D and C represent a diagonal or a diagonal length of the central portion 29*a* and a center of the center portion 29*a*, i.e., an intersection of the diagonals D, respectively.

Figure 4:
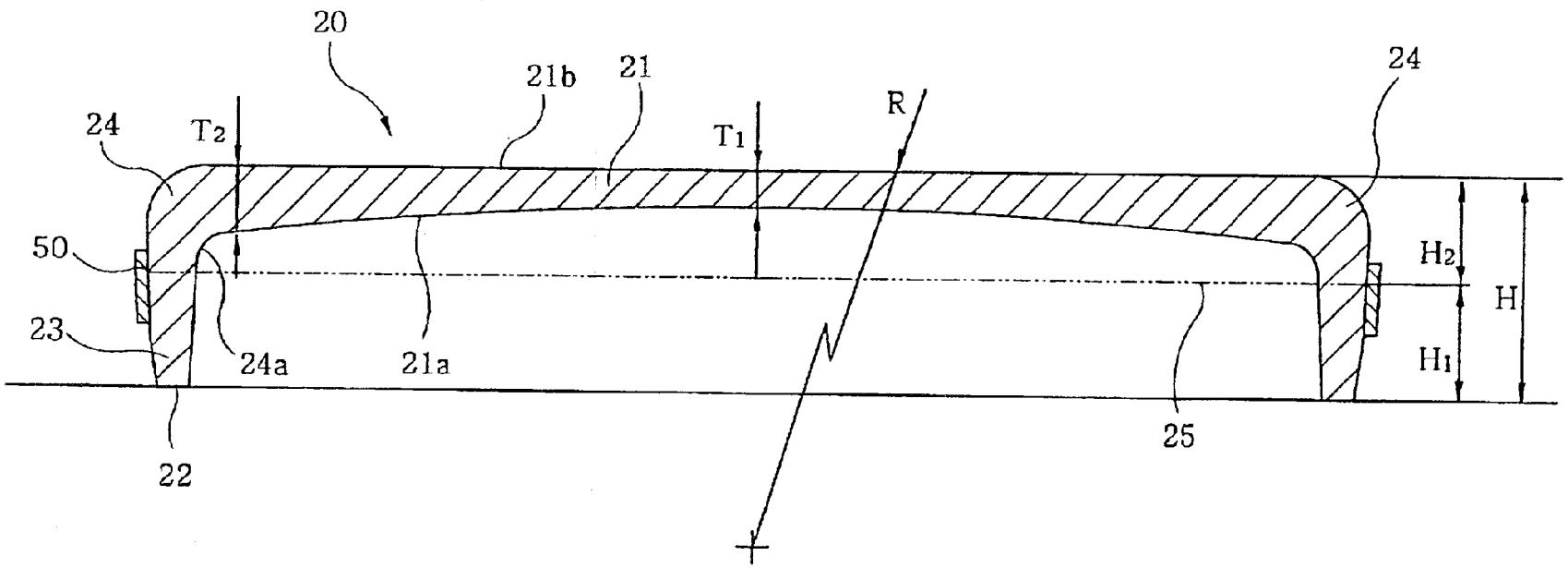
FIG. 4 sets forth a schematic cross sectional view taken along the line A—A in FIG. 3.

Referring to FIG. 4, there is illustrated a schematic cross sectional view taken along the line A—A in FIG. 3. The flat panel 20 includes also a skirt portion 23 extending backward from the periphery portion 29*b* of the face portion 21 and having a seal edge which is connected to a funnel 30 (shown in FIG. 1) by a glass frit material; and a blend round portion 24 (or corner portion) joining the face portion 21 with the skirt portion 23. And placed by way of the so-called "shrinkage fit" scheme around an outer periphery of the skirt portion 23 is a metallic implosion-proof band 50.

As shown in FIG. 4, a center thickness T1 represents a thickness of the face portion 21 at the center C. In addition, an inner contour 24*a* of the blend round portion 24 forms an arc having a point of tangency with an inner contour 21*a* of the face portion 21, and the thickness of the face portion 21 at the point of tangency, i.e., the thickest point in the face portion 21, is referred to as a periphery thickness T2. And the center thickness T1 and the periphery thickness T2 are measured along a line perpendicular to an outer contour 21*b* of the face portion 21.

Further, an overall height H represents a distance between a first plane passing through the seal edge 22 and a second plane tangent to the outer contour 21*b* and parallel to the first plane. A first mold match line height H1 represents a distance between the first plane and a third plane passing through the mold match line 25, and a second mold match line height H2 represents a distance between the third plane and the second plane. Moreover, a mean outer curvature radius R is an average of curvature radii of outer contours passing through the center C in predetermined directions.

In the flat panel 20, the mean outer curvature radius R is equal to or greater than 10,000 mm, and a wedge rate defined as a rate of the periphery thickness T2 to the center periphery T1 (T2/T1) is equal to or greater than 1.5.

Further, if the diagonal length D of the center portion 29*a* is equal to or less than 500 mm, the second mold match line height H2 (mm) satisfies the following equation:

$$8 \leqq H2 \leqq T1 \times 2.24 - D^{0.5} \times 0.027 \quad \text{Eq. 1}$$

The minimum value of H2, 8 mm, is large enough to prevent the blend round portion from becoming sharp, and the maximum value of H2 is determined in a manner that a reduction of the vacuum stress by the installation of the implosion-proof band 50 is greater than 10%.

Experiment 1

There were prepared one CRTs 1 adopting a conventional flat panel and two CRTs 2 and 3 adopting flat panels in accordance with the preferred embodiment, which were for televisions of 17-inch model (D=406.7), each having the effective picture plane of an aspect ratio of 4:3. Vacuum stresses were measured before and after the installation of the implosion-proof band 50. The results are listed in Table 1:

TABLE 1

| | T1 (mm) | H (mm) | H1 (mm) | H2 (mm) | Measuring position | Vacuum stress (MPa) | Vacuum stress after installing band (MPa) | Variation rate (%) |
|---|---|---|---|---|---|---|---|---|
| CRT 1 | 11.0 | 63.5 | 37.5 | 26 | short side | 4.99 | 4.53 | −9.2 |
| | | | | | long side | 3.03 | 2.74 | −9.6 |
| | | | | | diagonal | 2.32 | 1.40 | −39.7 |
| CRT 2 | 11.0 | 63.5 | 50.0 | 13.5 | short side | 5.05 | 4.35 | −13.8 |
| | | | | | long side | 3.07 | 2.50 | −18.6 |
| | | | | | diagonal | 2.30 | 0.08 | −96.4 |
| CRT 3 | 11.0 | 63.5 | 53.5 | 10.0 | short side | 5.14 | 4.33 | −15.7 |
| | | | | | long side | 3.13 | 2.44 | −22.1 |
| | | | | | diagonal | 2.26 | 0.07 | −97.0 |

In Table 1, vacuum stresses for 'short side', 'long side' and 'diagonal' correspond to vacuum stresses measured at a middle point of the short side in a direction parallel to the short side, a middle point of the long side in a direction parallel to the long side and a corner of the center portion of the face portion in a direction parallel to the diagonal.

As indicated in Table 1, although the vacuum stresses for the short side, the long side and the diagonal rose slightly as the location of the mold match line 25 approached the face portion 21, they were reduced phenomenally by the installation of the implosion-proof band. The variation rate of the maximum vacuum stress for the CRT 1 was −9.2%, being greater than −10%, while the variation rates of the maximum vacuum stresses for the CRTs 2 and 3 were −13.8% and −15.7%, respectively. That is, when the implosion-proof band is installed near the face portion, comparatively greater reduction of the vacuum stress can be obtained by using a flat panel in accordance with the preferred embodiment of the present invention. Further, since the mold match line heights H2 for CRTs 2 and 3 were greater than 8 mm, the blend round portion was prevented from becoming sharp.

Consequently, an implosion-resistance of the CRTs 2 and 3 improved without causing a sharp round of the blend round portion.

Next, if the diagonal length D of the center portion 29*a* is 500<D≦670, then the second mold match line height H2 (mm) satisfies the following equation:

$$8 \leqq H2 \leqq T1 + T1/6.42 - D^{0.5} \times 0.027 \qquad \text{Eq. 2}$$

Experiment 2

There were prepared one CRT 4 adopting a conventional flat panel and two CRTs 5 and 6 adopting flat panels in accordance with the preferred embodiment, which were for televisions of 25-inch model (D=590 mm), each flat panel having the effective picture plane of an aspect ratio of 4:3. Vacuum stresses were measured in a same way as in Experiment 1 before and after the installation of the implosion-proof band 50. The results are listed in Table 2:

TABLE 2

| CRT | T1 (mm) | H (mm) | H1 (mm) | H2 (mm) | Measuring position | Vacuum stress (MPa) | Vacuum stress after installing band (MPa) | Variation rate (%) |
|---|---|---|---|---|---|---|---|---|
| CRT 4 | 12.0 | 91.0 | 76.0 | 15 | short side | 6.16 | 5.60 | −9.1 |
| | | | | | long side | 7.46 | 6.74 | −9.7 |
| | | | | | diagonal | 3.63 | 1.10 | −67.0 |
| CRT 5 | 12.0 | 91.0 | 78.5 | 12.5 | short side | 6.18 | 5.50 | −11 |
| | | | | | long side | 7.47 | 6.55 | −12.3 |
| | | | | | diagonal | 3.60 | −0.01 | −100.2 |
| CRT 6 | 12.0 | 91.0 | 81 | 10.0 | short side | 6.19 | 5.45 | −12.1 |
| | | | | | long side | 7.49 | 6.53 | −12.8 |
| | | | | | diagonal | 3.58 | −0.07 | −102.0 |

As indicated in Table 2, although the vacuum stresses for the short side, the long side and the diagonal rose slightly as the forming position of the mold match line approached the face portion, they were phenomenally reduced by the installation of the implosion-proof band. The variation rate of the maximum vacuum stress for the CRT 4 was −9.7%, being greater than −10%, while the variation rates of the maximum vacuum stresses for the CRTs 5 and 6 were −12.3% and −12.8%, respectively. Moreover, in CRTs 8 and 9, the vacuum stresses in a diagonal direction were changed from a tensile stress to a compressive stress. That is, when the implosion-proof band is installed near the face portion, comparatively greater reduction of the vacuum stress can be obtained by using a flat panel in accordance with the preferred embodiment of the present invention. Further, since the mold match line heights H2 for CRTs 5 and 6 were greater than 8 mm, the blend round portion was prevented from becoming sharp.

Consequently, an implosion-resistance of the CRTs 5 and 6 improved without causing a sharp round of the blend round portion.

Next, if the diagonal length D of the center portion 29*a* is greater than 670 mm, then the second mold match line height H2 (mm) satisfies the following equation:

$$8 \leqq H2 \leqq T1 + T1/0.856 - D^{0.5} \times 0.027 \quad \text{Eq. 3}$$

Experiment 3

There were prepared one CRT 7 adopting a conventional flat panel and two CRTs 8 and 9 adopting flat panels in accordance with the preferred embodiment, which are for televisions of 29-inch model (D=676 mm), each flat panel having the effective picture plane of an aspect ratio of 4:3. Vacuum stresses were measured in a same way as in Experiment 1 before and after the installation of the implosion-proof band. The results are listed in the following Table 3.

TABLE 3

| CRT | T1 (mm) | H (mm) | H1 (mm) | H2 (mm) | Measuring position | Vacuum stress (MPa) | Vacuum stress after installing band (MPa) | Variation rate (%) |
|---|---|---|---|---|---|---|---|---|
| CRT 7 | 12.5 | 97.6 | 69.6 | 28.0 | short side | 7.08 | 6.51 | −8.1 |
| | | | | | long side | 8.57 | 7.81 | −8.9 |
| | | | | | diagonal | 4.17 | 1.33 | −68.1 |
| CRT 8 | 12.5 | 97.6 | 74.6 | 23.0 | short side | 7.10 | 6.11 | −14.1 |
| | | | | | long side | 8.59 | 7.28 | −15.2 |
| | | | | | diagonal | 4.14 | −0.01 | −100.3 |
| CRT 9 | 12.5 | 97.6 | 77.1 | 20.5 | short side | 7.12 | 6.05 | −15.0 |
| | | | | | long side | 8.61 | 7.26 | −15.7 |
| | | | | | diagonal | 4.12 | −0.08 | −101.8 |

As indicated in Table 3, although the vacuum stresses for the short side, the long side and the diagonal slightly rose as the forming position of the mold match line approached the face portion, they are phenomenally reduced by the installation of the implosion-proof band. The variation rate of the maximum vacuum stress for the CRT 7 was −8.9%, being greater than −10%, while the variation rates of the maximum vacuum stresses for the CRTs 7 and 8 were −15.2% and −15.7%, respectively. Moreover, in CRTs 8 and 9, the vacuum stresses in a diagonal direction were changed from a tensile stress to a compressive stress. That is, when the implosion-proof band is installed near the face portion, comparatively greater reduction of the vacuum stress can be obtained by using a flat panel in accordance with the preferred embodiment of the present invention. Further, since the mold match line heights H2 for CRTs 8 and 9 were greater than 8 mm, the blend round portion was prevented from becoming sharp.

Consequently, an implosion-resistance of the CRTs 8 and 9 improved without causing a sharp round of the blend round portion.

Further, in the flat panel 20 in accordance with the preferred embodiment, the overall height H of the flat panel 20 and the diagonal length D of the effective picture plane satisfy the following equation:

$$H/D \leqq 0.145 \quad \text{Eq. 4}$$

Therefore, the overall height H is short, which prevents the skirt portion 23 from being bent inwardly when the upper mold 64 is extracted from the bottom mold 62.

While the invention has been shown and described with respect to the preferred embodiments, it will be understood by those skilled in the art that various changes and modifications may be made without departing from the spirit and scope of the invention as defined in the following claims.

What is claimed is:

1. A flat panel for use in a cathode ray tube, comprising:

a face portion having a center portion for displaying picture images and a periphery portion;

a skirt portion extending from the periphery portion of the face portion and having an seal edge on its back edge;

a mold match line formed on an outer periphery of the skirt portion; and a blend round portion joining the face portion with the skirt portion, wherein a mean outer contour curvature radius is equal to or greater than 10,000 mm, a wedge rate is equal to or less than 1.5, a diameter length D of the center portion is equal to or less than 500 mm, and a distance H2 satisfies the following equation:

$$8 \leqq H2 \leqq T1 \times 2.24 - D^{0.5} \times 0.027$$

where the distance H2 is a distance between a first plane passing through the mold match line and a second plane tangent to an outer contour of the face portion and parallel to the first plane.

2. The flat panel of claim 1, wherein an overall height H of the flat panel satisfies the following equation:

$$H/D \leqq 0.145$$

where the overall height H is a distance between the second plane and a third plane passing through the seal edge of the skirt portion.

3. A flat panel for use in a cathode ray tube, comprising:

a face portion having a center portion for displaying picture images and a periphery portion;

a skirt portion extending from the periphery portion of the face portion and having an seal edge on its back edge;

a mold match line formed on an outer periphery of the skirt portion; and a blend round portion joining the face portion with the skirt portion, wherein a mean outer contour curvature radius is equal to or greater than 10,000 mm, a wedge rate is equal to or less than 1.5, a diameter length D of the center portion is 500 mm<D≦670 mm, and a distance H2 satisfies the following equation:

$$8 \leqq H2 \leqq T1 + T1/6.42 - D^{0.5} \times 0.027$$

where the distance H2 is a distance between a first plane passing through the mold match line and a second plane tangent to an outer contour of the face portion and parallel to the first plane.

4. The flat panel of claim 3, wherein an overall height H of the flat panel satisfies the following equation:

$$H/D \leqq 0.145$$

where the overall height H is a distance between the second plane and a third plane passing through the seal edge of the skirt portion.

5. A flat panel for use in a cathode ray tube, comprising:

a face portion having a center portion for displaying picture images and a periphery portion;

a skirt portion extending from the periphery portion of the face portion and having an seal edge on its back edge;

a mold match line formed on an outer periphery of the skirt portion; and a blend round portion joining the face portion with the skirt portion, wherein a mean outer contour curvature radius is equal to or greater than 10,000 mm, a wedge rate is equal to or less than 1.5, a diameter length D of the center portion is greater than 670 mm, and a distance H2 satisfies the following equation:

$$8 \leqq H2 \leqq T1 + T1/0.856 - D^{0.5} \times 0.027$$

where the distance H2 is a distance between a first plane passing through the mold match line and a second plane tangent to an outer contour of the face portion and parallel to the first plane.

6. The flat panel of claim 5, wherein an overall height H of the flat panel satisfies the following equation:

$$H/D \leqq 0.145$$

where the overall height H is a distance between the second plane and a third plane passing through the seal edge of the skirt portion.

* * * * *